US007623815B2

(12) United States Patent
Mori et al.

(10) Patent No.: US 7,623,815 B2
(45) Date of Patent: Nov. 24, 2009

(54) DEVELOPING DEVICE AND IMAGE FORMING APPARATUS

(75) Inventors: Hiroki Mori, Nagoya (JP); Yuichi Matsushita, Nagoya (JP); Yukiko Nakaya, Konan (JP); Fan Xu, Nagoya (JP); Mitsuru Horinoe, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 145 days.

(21) Appl. No.: 11/843,403

(22) Filed: Aug. 22, 2007

(65) Prior Publication Data

US 2008/0050153 A1 Feb. 28, 2008

(30) Foreign Application Priority Data

Aug. 22, 2006 (JP) ..... 2006-225425
Aug. 22, 2006 (JP) ..... 2006-225426

(51) Int. Cl.
*G03G 15/08* (2006.01)

(52) U.S. Cl. ..... 399/284; 399/103; 399/274

(58) Field of Classification Search ..... 399/284, 399/274, 102, 103, 107, 350, 351; 118/261
See application file for complete search history.

(56) References Cited

U.S. PATENT DOCUMENTS

| | | | | |
|---|---|---|---|---|
| 5,517,294 | A * | 5/1996 | Ogiri et al. | 399/351 |
| 6,282,395 | B1 * | 8/2001 | Nittani et al. | 399/284 |
| 6,901,228 | B2 | 5/2005 | Kamimura et al. | |
| 2005/0254862 | A1 * | 11/2005 | Toba et al. | 399/284 |
| 2006/0140683 | A1 * | 6/2006 | Takami | 399/284 |
| 2006/0171747 | A1 * | 8/2006 | Ishii | 399/284 |

FOREIGN PATENT DOCUMENTS

| | | |
|---|---|---|
| JP | 2-025866 | 1/1990 |
| JP | 2002-287487 | 10/2002 |

* cited by examiner

*Primary Examiner*—Sophia S Chen
(74) *Attorney, Agent, or Firm*—Banner & Witcoff, Ltd

(57) ABSTRACT

There is provided a developing device including: a casing; a developing roller held by the casing and carrying a developing agent; and a layer-thickness regulating blade for regulating a layer thickness of the developing agent carried on the developing roller, in which in the state where the developing roller is held by the casing, the tip end portion of the layer-thickness regulating blade abuts against the developing roller at a uniform pressure in the axial direction of the developing roller, and in the state where the developing roller is not held by the casing, the layer-thickness regulating blade is bent toward a disposed position of the developing roller.

18 Claims, 12 Drawing Sheets

40

DEVELOPING DEVICE AND IMAGE FORMING APPARATUS

CROSS REFERENCE TO RELATED APPLICATIONS

This application claims priority to Japanese Patent Application No. 2006-225425 and Japanese Patent Application No. 2006-225426 filed on Aug. 22, 2006, the disclosures of which are hereby incorporated into the present application by reference.

TECHNICAL FIELD

The present invention relates to an image forming apparatus such as a laser printer, and a developing device provided therein.

BACKGROUND

In an image forming apparatus, an electrostatic latent image is formed on a surface of a photosensitive drum. A toner is supplied to the electrostatic latent image from a developing device, so that the electrostatic latent image is visualized in a toner image, whereby the toner image is carried on the surface of the photosensitive drum. Then, the toner image is transferred onto a sheet, resulting in achievement of image formation onto the sheet.

The developing device includes a casing having an opening that is opened toward the photosensitive drum, a developing roller that carries a toner accommodated in the casing, and a layer-thickness regulating blade for regulating a layer thickness of the toner carried on the developing roller. The developing roller is rotatably supported at the opening of the casing with a portion of the surface thereof exposed. The layer-thickness regulating blade is extended along the axial direction of the developing roller, and a pressing portion having a semicircular section provided at the distal-end portion thereof is in pressure contact with the surface of the developing roller.

The toner in the casing is supplied onto the surface of the developing roller, and then passes through between the pressing portion of the layer-thickness regulating blade and the surface of the developing roller, along with the rotation of the developing roller. This passage allows the toner to be carried on the surface of the developing roller while forming a thin layer having a uniform thickness. The toner thus carried on the surface of the developing roller is supplied to the electrostatic latent image formed on the surface of the photosensitive drum when coming in contact with the surface of the photosensitive drum.

The layer-thickness regulating blade includes a support member attached to the casing, and a leaf-spring member extended toward the developing roller from the support member. The pressing portion is provided at the tip end portion (distal-end portion) of the leaf-spring member.

The support member includes a back support member, and a front support member arranged in opposed relation thereto. The support member is fixed to the casing with a screw that penetrates the front support member, the leaf-spring member, and the back support member while sandwiching the proximal edge of the leaf-spring member (end portion of the side opposite to a side where the pressing portion is provided) between the back support member and the front support member.

However, when both end portions of the support member in the longitudinal direction are fixed to the casing with the screws, the center portion of the support member in the longitudinal direction may bend in a direction in which the pressing portion is spaced away from the surface of the developing roller. Thus, when the support member bends, the leaf-spring member also bends. Therefore, the pressing portion cannot be uniformly brought into pressure contact with the developing roller in its axial direction. As a result, the layer thickness of the toner carried on the surface of the developing roller is not uniform, thereby generating streaks in the image formed on a sheet due to undesired density unevenness.

When a local force acts on a portion in which the screw penetrates the leaf-spring member, there is a possibility that the leaf-spring member may be deformed so as to be waved. When such deformation arises, the pressing portion cannot be uniformly brought into pressure contact with the developing roller in its axial direction.

To cope with this problem, there has been proposed that a developing-agent restricting member equivalent to the leaf-spring member is fixed to the support member by adhesion. However, with the proposed arrangement, dust or the like adheres to an adhesive layer between the developing-agent restricting member and the support member. A small image forming apparatus such as a laser printer cannot define a sufficient space between the optical path of laser light which is irradiated to a surface of a photosensitive drum from the exposure device and a support member. Therefore, when dust or the like adheres to the adhesive layer, the adhered dust or the like lies on the optical path of laser light. This interrupts the optical path, thereby producing streaks (white streaks) in the image formed on a sheet due to exposure failure.

SUMMARY

One aspect of the present invention may provide a developing device and an image forming apparatus, capable of uniformly regulating a layer thickness of a developing agent carried on a surface of a developing roller.

Another aspect of the present invention may provide a developing device and an image forming apparatus, capable of securing good exposure of an image carrier in an arrangement in which a support member and a leaf-spring member are fixed by adhesion.

The same or different aspect of the present invention may provide a developing device including: a casing; a developing roller held by the casing and carrying a developing agent; and a layer-thickness regulating blade for regulating a layer thickness of the developing agent carried on the developing roller, in which the layer-thickness regulating blade includes: a support member that is formed in a rectangular shape extending in an axial direction of the developing roller, and is attached to the casing; a leaf-spring member that is supported by the support member and extends toward the developing roller from the support member; and an abutment portion provided at a tip end portion of the leaf-spring member and abutting against the developing roller, and in which in a state where the developing roller is held by the casing, the abutment portion abuts against the developing roller at a uniform pressure in the axial direction of the developing roller, and in a state where the developing roller is not held by the casing, the support member is attached in the casing so that the layer-thickness regulating blade is bent toward a disposed position of the developing roller.

One or more aspects of the present invention may provide an image forming apparatus including: a casing; a developing roller held by the casing and carrying a developing agent; a layer-thickness regulating blade for regulating a layer thickness of the developing agent carried on the developing roller; and an image carrier supplied with a developing agent from the developing roller, in which the layer-thickness regulating blade includes: a support member formed in a rectangular shape extending in an axial direction of the developing roller, and attached to the casing; a leaf-spring member that is supported by the support member and extends toward the developing roller from the support member; and an abutment portion provided at a tip end portion of the leaf-spring member and abutting against the developing roller, and in which in a state where the developing roller is held by the casing, the abutment portion abuts against the developing roller at a uniform pressure in the axial direction of the developing roller, and in a state where the developing roller is not held by in the casing, the support member is attached in the casing so that the layer-thickness regulating blade is bent toward a disposed position of the developing roller.

One or more aspects of the present invention may provide a developing device for developing with a developing agent an electrostatic latent image formed by irradiating with light a surface of an image carrier provided in an image forming apparatus, including: a casing; a developing roller held by the casing and carrying a developing agent to be supplied onto the surface of the image carrier; and a layer-thickness regulating blade for regulating a layer thickness of the developing agent carried on the developing roller, in which the layer-thickness regulating blade includes: a support member attached in the casing, and arranged in a position closer to an optical path of the light irradiated onto the image carrier than the developing roller; a leaf-spring member that is supported by the support member and extends toward the developing roller from the support member; an abutment portion provided at a tip end portion of the leaf-spring member and abutting against the developing roller; and an adhesive layer arranged between the support member and the leaf-spring member so as to be spaced at a given width from a proximal end edge of the leaf-spring member on the other side of the tip end portion thereof to a tip end portion side, for fixing the support member and the leaf-spring member by adhesion, and in which a portion of the given width from the proximal end edge of the leaf-spring member is opposed to the support member without the adhesive layer interposed therebetween.

One or more aspects of the present invention may provide an image forming apparatus including: an image carrier; an exposure device for forming an electrostatic latent image by irradiating a surface of the image carrier with light; and a developing device for developing the electrostatic latent image with a developing agent, in which the developing device includes: a casing; a developing roller held by the casing and carrying the developing agent to be supplied onto the surface of the image carrier; and a layer-thickness regulating blade for regulating a layer thickness of the developing agent carried on the developing roller, in which the layer-thickness regulating blade includes: a support member attached in the casing, and arranged in a position closer to an optical path of the light irradiated onto the image carrier than the developing roller; a leaf-spring member that is supported by the support member and extends toward the developing roller from the support member; an abutment portion provided at a tip end portion of the leaf-spring member and abutting against the developing roller; and an adhesive layer that is arranged between the support member and the leaf-spring member so as to be spaced at a given width from a proximal end edge of the leaf-spring member on the other side of the tip end portion thereof to a tip end portion side, for fixing the support member and the leaf-spring member by adhesion, and in which a portion of the given width from the proximal end edge of the leaf-spring member is opposed to the support member without the adhesive layer interposed therebetween.

DETAILED DESCRIPTION

Figure 1:
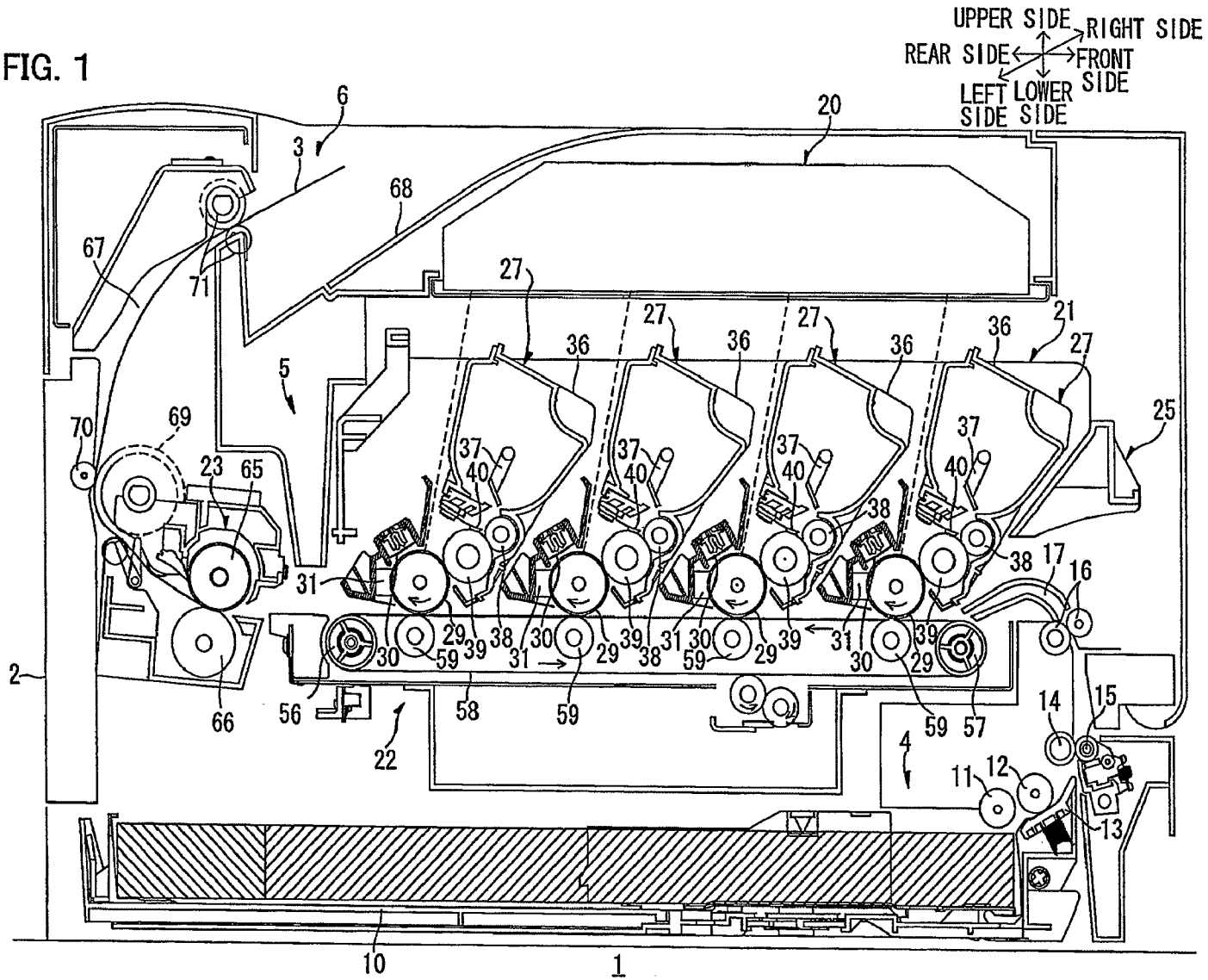
FIG. 1 is a side sectional view of a color laser printer as an example of an image forming apparatus according to one embodiment of the present invention.

The embodiments of the present invention will be described below while referring to the drawings.

First Embodiment

1. General Structure of Color Laser Printer

FIG. 1 is a side sectional view of a color laser printer as an example of an image forming apparatus according to one embodiment of the present invention.

The color laser printer 1 is of a horizontal-tandem type, in which a plurality of photosensitive drums 29 described later are horizontally arranged in juxtaposition.

The color laser printer 1 includes a sheet feeding section 4 for feeding a sheet 3, an image forming section 5 for forming an image on the fed sheet 3 and a sheet ejecting section 6 for ejecting the sheet 3 formed with the image in the main body casing 2.

(1) Main Body Casing

The main body casing 2 is formed in a box-like shape of a generally rectangle in side view. A drum unit 25 described later is provided in the main body casing 2.

In the following description, the right side of FIG. 1 is referred to as the front side (front view side), while the left side of FIG. 1 is referred to as the rear side (rear view side). A left and right direction is determined when the color laser printer 1 is viewed from the front side. The left and right direction is the same as a width direction. Further, the drum unit 25 and a developer cartridge 27 described later will be explained based on the directions while they are mounted in the main body casing 2, unless otherwise noted.

(2) Sheet Feeding Section

The sheet feeding section 4 includes a sheet feeding tray 10 that is detachably mounted in the bottom portion of the main body casing 2. A sheet feed roller 11 is arranged above the front end portion of the sheet feeding tray 10. Further, the sheet feeding section 4 includes a sheet feeding transport path 17 that is formed generally in a U-shape and provided between the upper portion of the front end portion of the sheet feeding tray 10 and a transport belt 58 described later. A separation roller 12, a separation pad 13, a pinch roller 14, a sheet dust removing roller 15, and a pair of resist rollers 16 are disposed on the sheet feeding transport path 17.

The sheet 3 stacked on the sheet feeding tray 10 is sent out to the sheet feeding transport path 17 by rotation of the sheet feed roller 11. The sheet 3 thus sent out passes along the sheet feeding transport path 17, and is then transported to the resist rollers 16. After the registration of the sheet 3, the resist rollers 16 send out the sheet 3 onto the transport belt 58 described later.

(3) Image Forming Section

The image forming section 5 includes a scanning section 20, a processing section 21, a transferring section 22, and a fixing section 23.

(3-1) Scanning Section

The scanning section 20 is arranged in the upper portion of the main body casing 2. The scanning section 20 includes optical members such as a laser, a mirror, and a lens. Four laser beams are emitted toward the four photosensitive drums 29 described later from the scanning section 20.

(3-2) Processing Section

The processing section 21 is arranged below the scanning section 20, but above the sheet feeding section 4. The processing section 21 includes one drum unit 25, and four developer cartridges 27 as an example of developing devices corresponding to respective colors of black, yellow, magenta, and cyan.

(3-2-1) Drum Unit

The drum unit 25 includes four sets of a photosensitive drum 29 as an example of image carriers corresponding to respective colors, a scorotron charger 30, and a cleaning brush 31.

The photosensitive drum 29 has a cylindrical shape, and its outermost surface layer is formed of a positively chargeable photosensitive layer. During an image forming operation, the photosensitive drums 29 are rotated by a driving force from a motor (not shown) provided in the main body casing 2.

The scorotron charger 30 is arranged obliquely rearward above the photosensitive drum 29 so as to be spaced in opposed relation thereto. During an image forming operation, the scorotron charger 30 charges the surface of the photosensitive drum 29 with a uniform positive polarity.

The cleaning brush 31 is arranged behind the photosensitive drum 29 so as to be opposed thereto in contact relation. During an image forming operation, a cleaning bias is applied to the cleaning brush 31.

(3-2-2) Developer Cartridge

Figure 2:
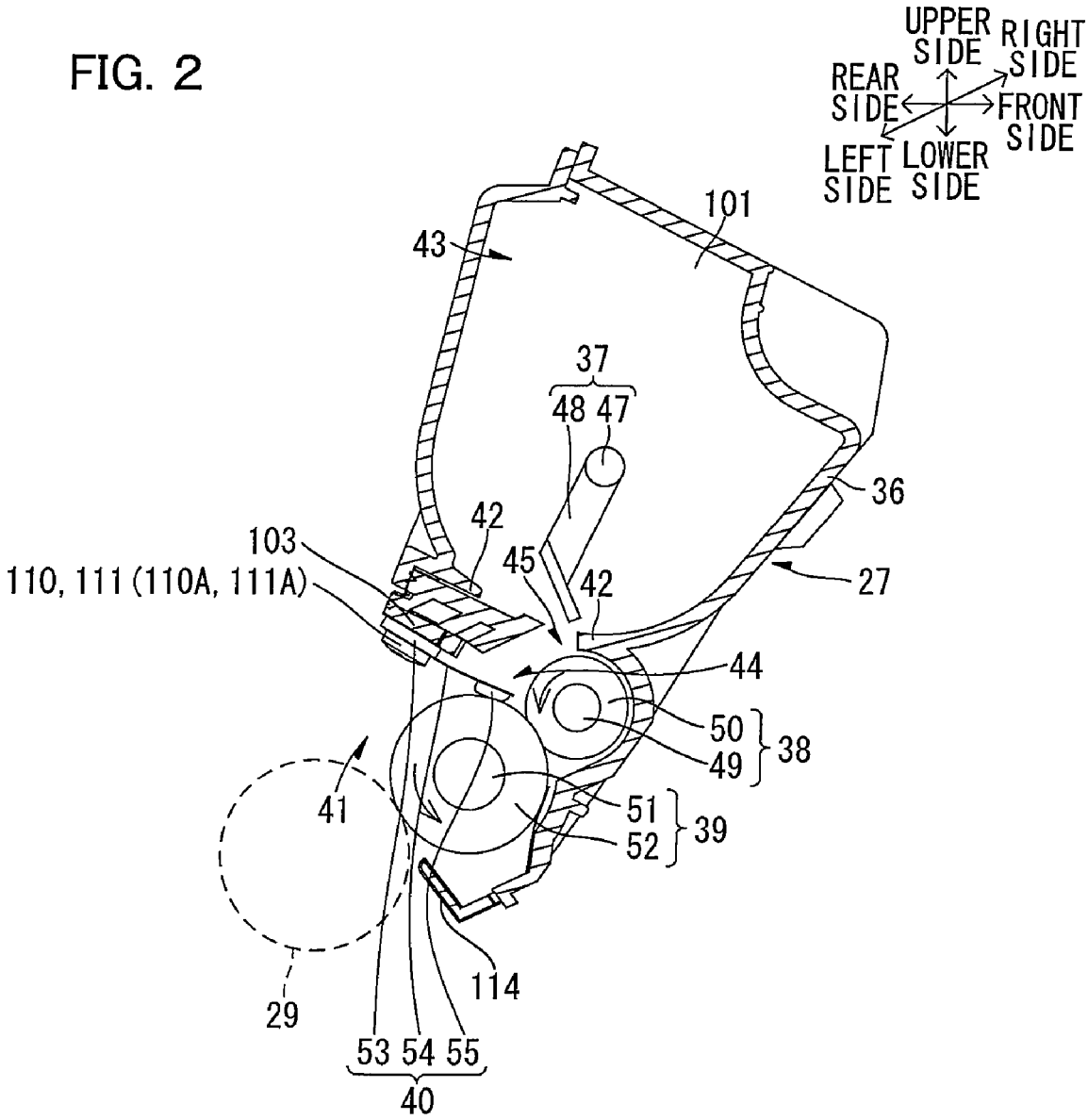
FIG. 2 is a side sectional view of a developer cartridge.

FIG. 2 is a side sectional view of the developer cartridge 27.

As shown in FIG. 2, each of the developer cartridges 27 corresponding to the photosensitive drums 29 of respective colors includes an agitator 37, a feed roller 38, a developing roller 39, and a layer-thickness regulating blade 40 in a casing 36.

The casing 36 is formed in a box-like shape with an opening 41 at a lower end portion thereof. An inner portion of the casing 36 is divided into a toner accommodation chamber 43 on the upper side and a developing chamber 44 on the lower side by a partition wall 42. A communication port 45 that allows the toner accommodation chamber 43 to communicate with the developing chamber 44 is formed in the partition wall 42.

The toner accommodation chamber 43 accommodates a toner as a developing agent of a color corresponding to each developer cartridge 27. As the toner of each color is used a positively-chargeable, non-magnetic, single-component polymerized toner, in which coloring agents of yellow, magenta, cyan, and black are mixed corresponding to each color.

The agitator 37 is provided in the toner accommodation chamber 43. The agitator 37 includes an agitator rotating shaft 47 that is rotatably supported on both side walls 101 of the casing 36, and an agitating member 48 extending outward in the radial direction from the agitator rotating shaft 47. During an image forming operation, a driving force from a motor (not shown) provided in the main body casing 2 is transmitted to the agitator rotating shaft 47. Thus, the agitating member 48 circularly moves in the toner accommodation chamber 43.

The feed roller 38 is provided below the communication port 45 in the developing chamber 44. The feed roller 38 includes a metal feed roller shaft 49 that is rotatably supported on the both side walls 101 of the casing 36, and a sponge roller 50 made of an electrically-conductive sponge that covers the feed roller shaft 49. During an image forming operation, the feed roller 38 is rotated by a driving force from a motor (not shown) provided in the main body casing 2.

The developing roller 39 is provided obliquely rearward below the feed roller 38 in the developing chamber 44. The developing roller 39 includes a metal developing roller shaft 51 that is rotatably supported on the both side walls 101 of the casing 36, and a rubber roller 52 made of an electrically-conductive rubber that covers the developing roller shaft 51. A part of the peripheral surface of the rubber roller 52 is exposed downward from the opening 41 of the developing chamber 44. Further, the rubber roller 52 is in pressure contact with the sponge roller 50 of the feed roller 38. During an image forming operation, the developing roller 39 is rotated by a driving force from a motor (not shown) provided in the main body casing 2. A developing bias is applied to the developing roller 39.

The layer-thickness regulating blade 40 includes a plate-like support member 53 that extends in the width direction, a leaf-spring member 54 that is fixed to the support member 53 by adhesion, and a pressure contact rubber 55 as an example of an abutment portion provided at a tip end portion (distal-end portion) of the leaf-spring member 54. Both end portions of the support member 53 in the width direction are fixed to the casing 36. The leaf-spring member 54 extends toward the developing roller 39. The pressure contact rubber 55 is brought into pressure contact with the rubber roller 52 of the developing roller 39 from above. The support member 53 is arranged at a position closer to laser beams irradiated onto the photosensitive drum 29 from the scanning section 20 than the developing roller 39.

(3-2-3) Developing Operation in Processing Section

In the developer cartridge 27, a toner accommodated in the toner accommodation chamber 43 moves to the communication port 45 while being agitated by the agitator 37, and is then released from the communication port 45 to the developing chamber 44. The toner thus released from the communication port 45 to the developing chamber 44 is supplied to the feed roller 38. The toner thus supplied to the feed roller 38 is then supplied to the developing roller 39 by rotation of the feed roller 38. At this time, the toner is triboelectrically charged with a positive polarity between the feed roller 38 and the developing roller 39 to which a developing bias is applied. The toner thus supplied to the developing roller 39 passes through between the pressure contact rubber 55 of the layer-thickness regulating blade 40 and the rubber roller 52 of the developing roller 39 along with the rotation of the developing roller 39. This passage allows the toner to be carried on the surface of the rubber roller 52 while forming a thin layer having a uniform thickness.

On the other hand, the surface of the photosensitive drum 29 is uniformly positively charged by the scorotron charger 30 along with the rotation of the photosensitive drum 29. Then, the laser beams from the scanning section 20 are irradiated onto the surface of the photosensitive drum 29 thus positively charged, as shown in FIG. 1, thereby forming an electrostatic latent image corresponding to the image to be formed on a sheet 3.

When the electrostatic latent image thus formed on the surface of the photosensitive drum 29 is opposed to the developing roller 39 by the rotation of the photosensitive drum 29, the positively charged toner carried on the surface of the developing roller 39 is supplied to the electrostatic latent image (i.e., in the surface of the photosensitive drum 29 uniformly positively charged, an exposed portion having a lower potential due to the exposure to the laser beams). Thus, the electrostatic latent image is transformed into a visible toner image. Thus, toner images corresponding to respective colors are carried on the surfaces of the respective photosensitive drums 29.

(3-3) Transferring Section

In the main body casing 2, the transferring section 22 is arranged above the sheet feeding section 4 but below the processing section 21. The transferring section 22 includes a driving roller 56, a driven roller 57, the transport belt 58, and transfer rollers 59.

The driving roller 56 and the driven roller 57 are anteroposteriorly spaced apart from each other in opposed relation. The transport belt 58 is an endless belt. The transport belt 58 is wound between the driving roller 56 and the driven roller 57.

During an image forming operation, the driving roller 56 is rotated by a driving force from a motor (not shown) provided in the main body casing 2. When the driving roller 56 rotates, the transport belt 58 circumferentially moves, and the driven roller 57 is driven thereby. The transport belt 58 rotates in a reverse direction to the photosensitive drums 29 at transfer positions where the transport belt 58 is opposed to and is in contact with the respective photosensitive drums 29.

The transfer rollers 59 are arranged in the inner side of the transport belt 58 at positions opposed to respective photosensitive drums 29 while sandwiching the transport belt 58 therewith. Each transfer roller 59 is opposed to and is in contact with the transport belt 58 at the transfer positions and is driven to rotate in the same direction as the circumferentially moving direction of the transport belt 58. During an image forming operation, a transfer bias is applied to each of the transfer rollers 59.

The sheet 3 fed from the sheet feeding section 4 is transported toward the rear side from the front side by the transport belt 58 that is circularly moved so that the sheet 3 sequentially passes through the transfer positions of the respective photosensitive drums 29. Then, during the transportation, color toner images carried on the respective photosensitive drums 29 are sequentially transferred and overlapped one another. Thus, a collar image is formed on the sheet 3.

(3-4) Fixing Section

The fixing section 23 is arranged behind the transferring section 22, and includes a heating roller 65 and a pressure roller 66 that pressurizes the heating roller 65.

In the fixing section 23, the color image thus transferred onto the sheet 3 is heated and pressurized while the sheet 3 passes through between the heating roller 65 and the pressure roller 66, thereby thermally fixing the color image onto the sheet 3.

(4) Sheet Ejecting Section

The sheet ejecting section 6 includes a sheet ejecting transport path 67 having a generally C-shape opening frontward. The sheet ejecting transport path 67 has a transport roller 69, a pinch roller 70 and a pair of sheet ejecting rollers 71 disposed thereon. The sheet 3 transported from the fixing section 23 passes along the sheet ejecting transport path 67, and is then ejected onto a sheet ejecting tray 68 formed on the upper surface of the main body casing 2.

2. Major Structure of Developer Cartridge

Figure 3:
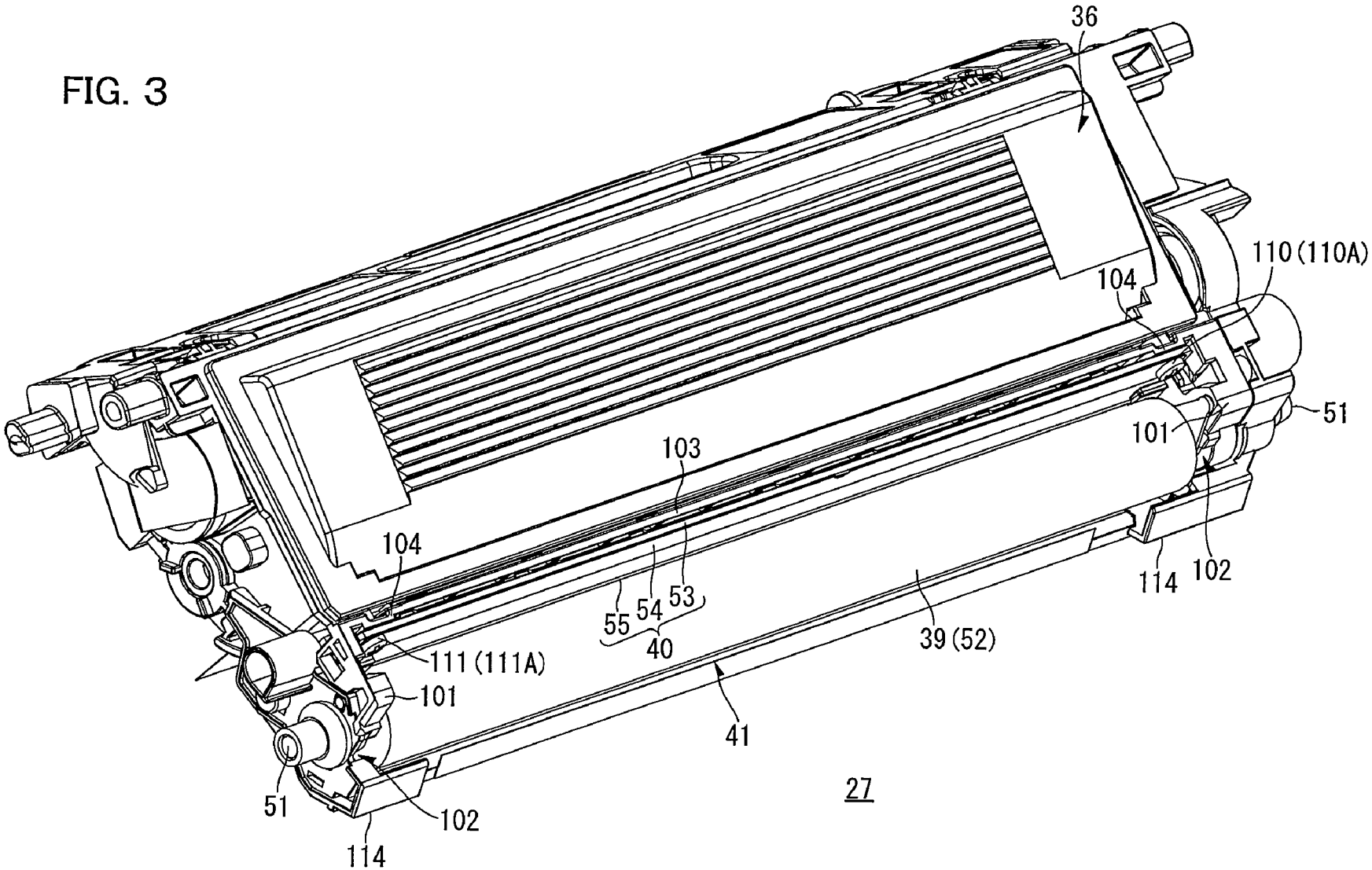
FIG. 3 is a perspective view of the developer cartridge.
Figure 4:
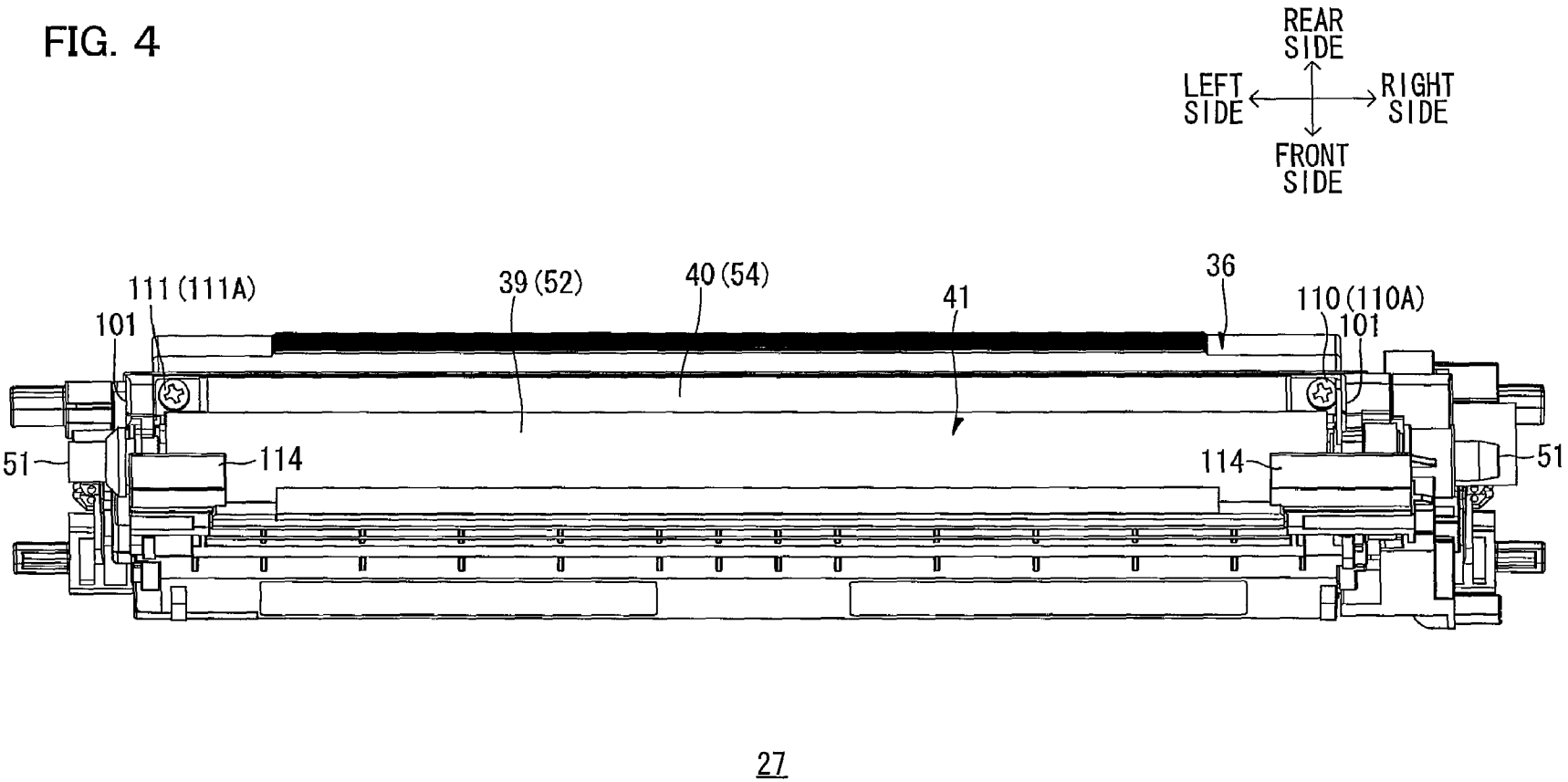
FIG. 4 is a bottom view of the developer cartridge with a developing roller attached therein.
Figure 5:
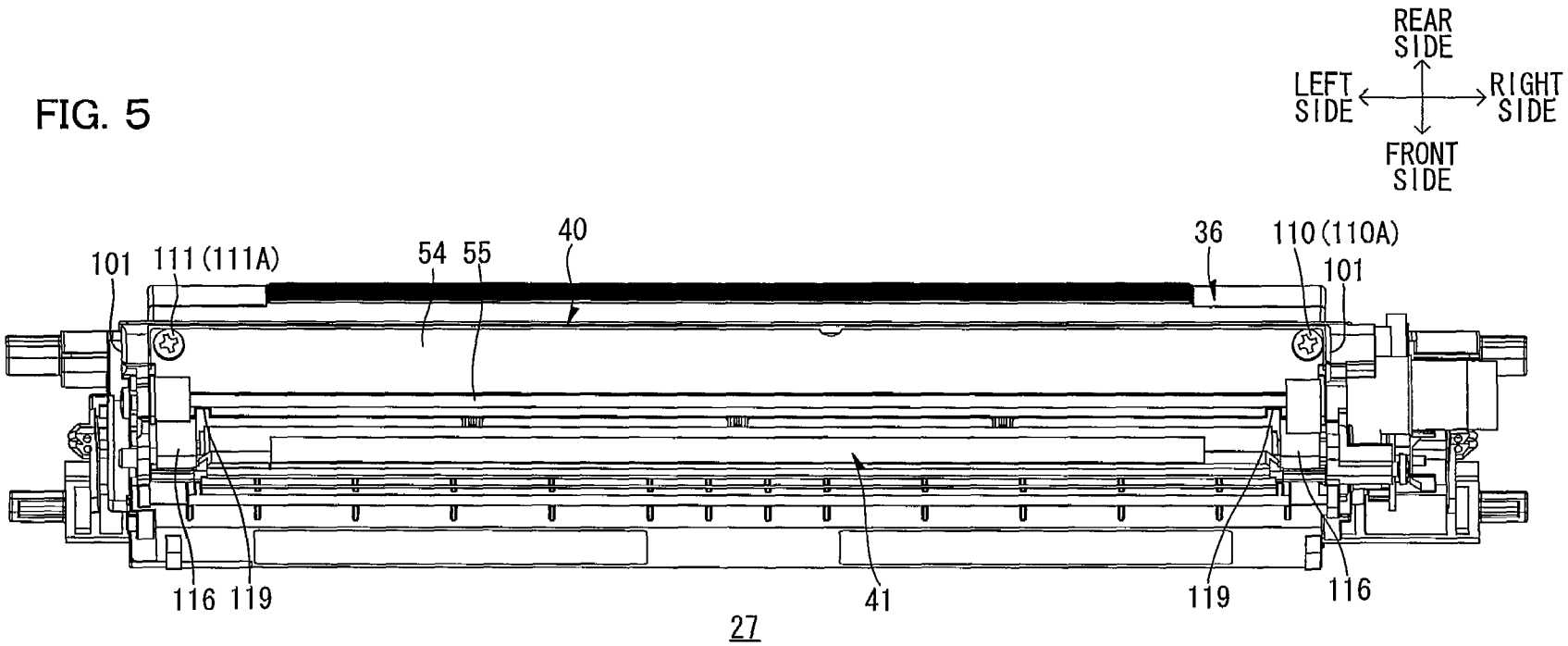
FIG. 5 is a bottom view of the developer cartridge with the developing roller detached therefrom.
Figure 6:
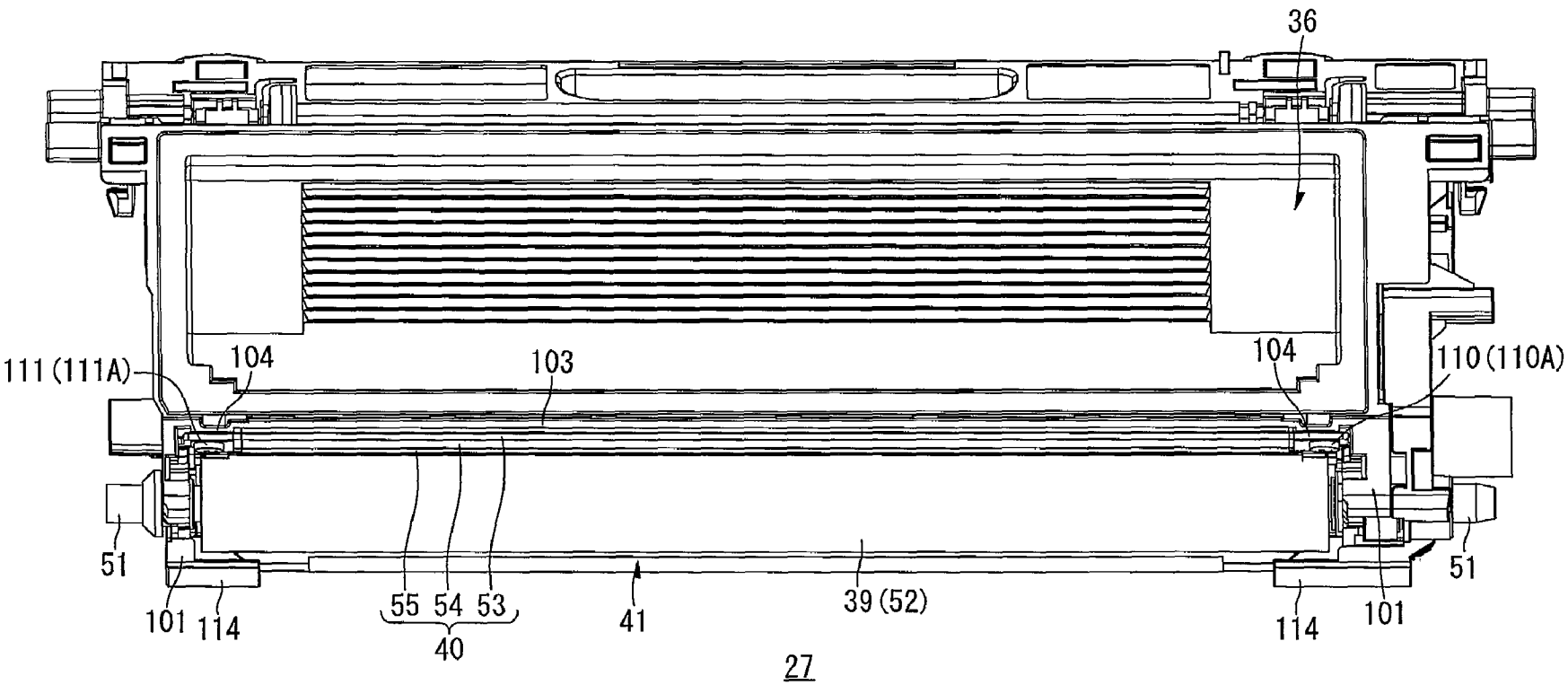
FIG. 6 is a rear view of the developer cartridge with the developing roller attached therein.
Figure 7:
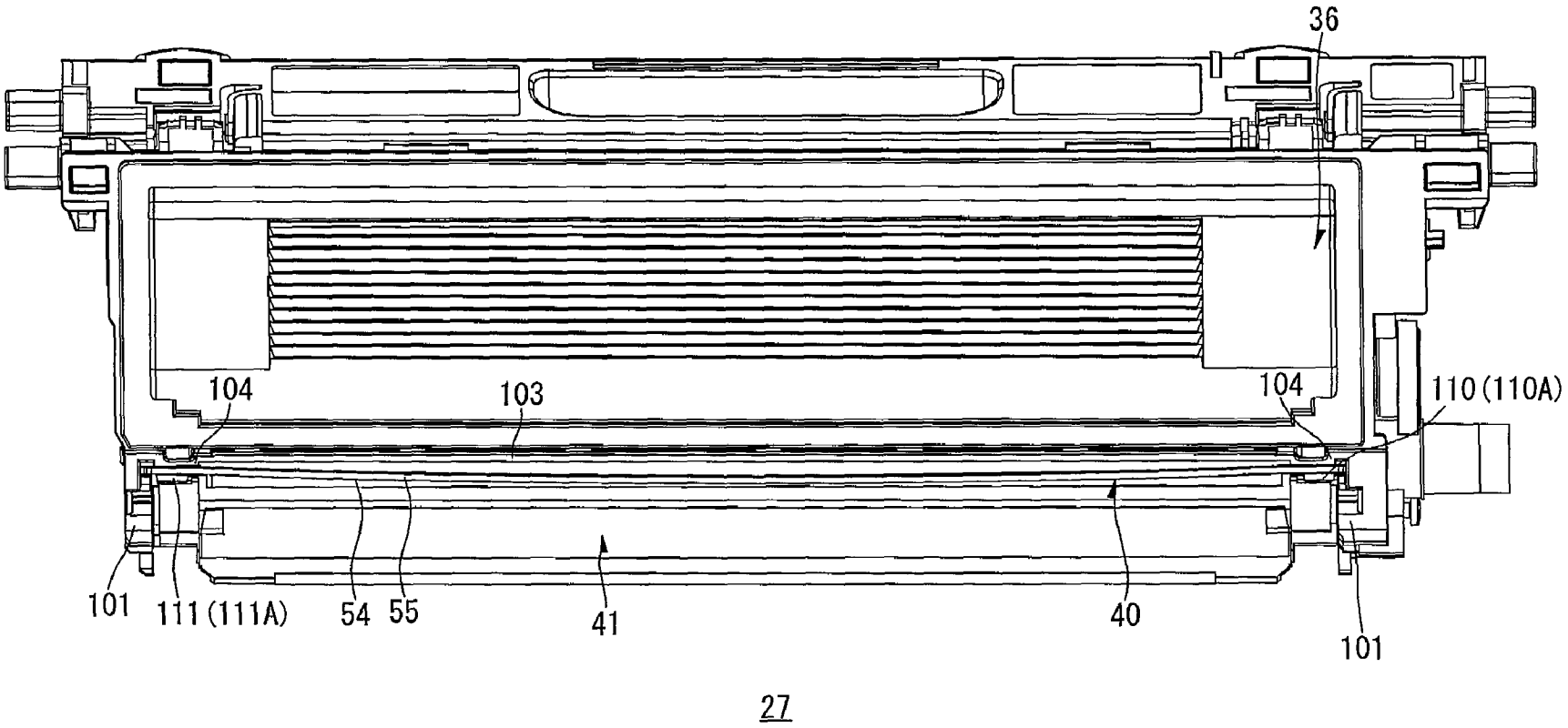
FIG. 7 is a rear view of the developer cartridge with the developing roller detached therefrom.

FIG. 3 is a perspective view of the developer cartridge 27. FIG. 4 is a bottom view of the developer cartridge 27 with the developing roller 39 attached therein. FIG. 5 is a bottom view of the developer cartridge 27 with the developing roller 39 detached therefrom. FIG. 6 is a rear view of the developer cartridge 27 with the developing roller attached 39 therein. FIG. 7 is a rear view of the developer cartridge 27 with the developing roller 39 detached therefrom.

(1) Casing

The casing 36 of the developer cartridge 27 is formed in a box-like shape as shown in FIG. 3. The opening 41 that extends in the width direction (longitudinal direction) is formed in the lower end portion of the casing 36.

The casing 36 includes the both side walls 101 that sandwich the opening 41 in the width direction. A shaft support groove 102 that is cut out upward from the lower end edge is formed in each of the side walls 101. The shaft support groove 102 receives each end portion of the developing roller shaft 51. Thus, the developing roller 39 is rotatably supported on the both side walls 101 of the casing 36.

The casing 36 is provided with a fixing wall 103 along the rear end edge portion of the opening 41. A blade fixing portion 104 that fixes both end portions of the layer-thickness regulating blade 40 (support member 53) in the width direction is formed at both end portions of the fixing wall 103 in the width direction. Each blade fixing portion 104 has a flat-bottomed U-shape in rear view protruding downward (to the developing roller 39 side).

As shown in FIGS. 3 and 4, the casing 36 is also provided with a receiving member 114 for preventing a toner from being dropped from the developing roller 39 below both end portions of the opening 41 in the width direction.

Further, as shown in FIG. 5, the casing 36 is provided with side seals 116 at the both end portions of the opening 41 in the width direction respectively. The side seals 116 prevent the toner carried on the developing roller 39 from leaking out of the casing 36 from both axial end portions of the developing roller 39.

(2) Layer-thickness Regulating Blade

Figure 8:
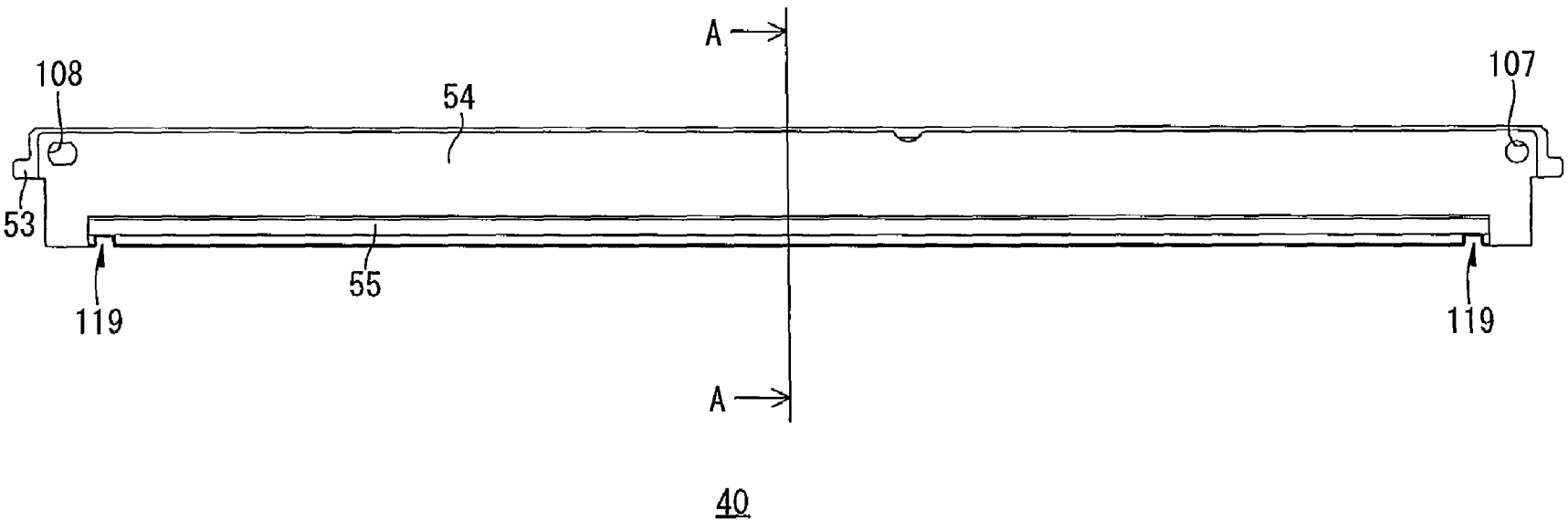
FIG. 8 is a bottom view (on the developing-roller side) of a layer-thickness regulating blade, which is shown alone.
Figure 9:
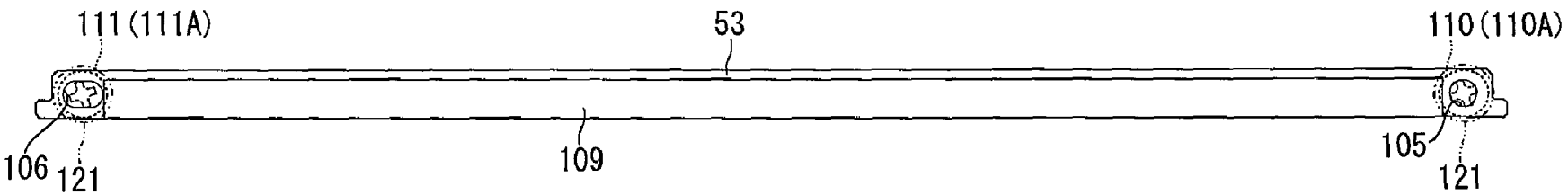
FIG. 9 is a bottom view of a support member of the layer-thickness regulating blade.
Figure 10:
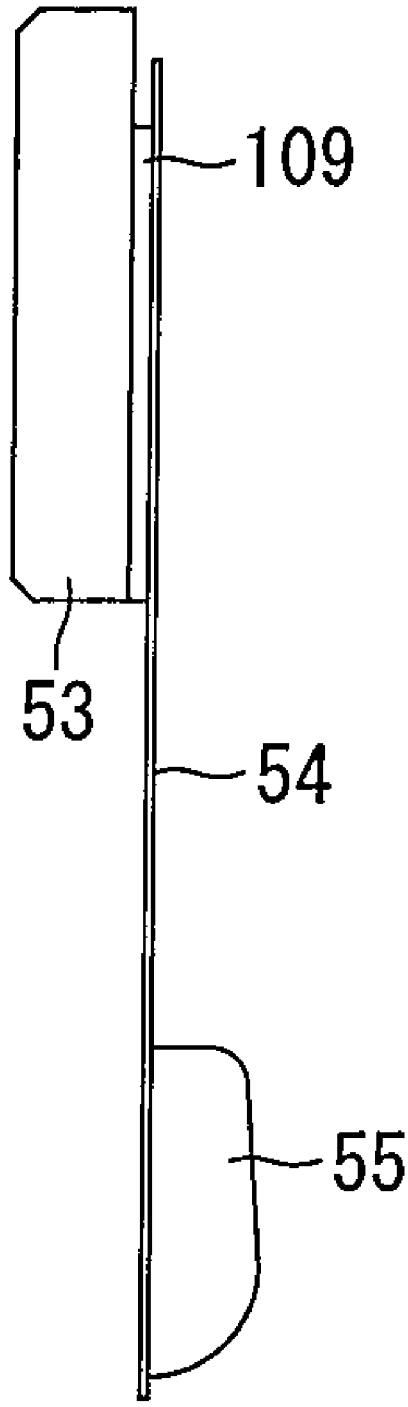
FIG. 10 is a sectional view of the layer-thickness regulating blade taken along the line A-A shown in FIG. 8.

FIG. 8 is a bottom view (on the developing-roller 39 side) of the layer-thickness regulating blade 40, which is shown alone. FIG. 9 is a bottom view of the support member 53 of the layer-thickness regulating blade 40. FIG. 10 is a sectional view of the layer-thickness regulating blade 40 taken along line A-A shown in FIG. 8.

As described above, the layer-thickness regulating blade 40 includes the support member 53, the leaf-spring member 54, and the pressure contact rubber 55.

(2-1) Support Member

The support member 53 comprises a steel sheet and is formed in a generally elongated rectangular shape in bottom view (i.e., the layer-thickness regulating blade 40 is viewed from the bottom side of the main body casing 2; the same applies to the following) extending in the width direction. The support member 53 is formed longer in the width direction (longitudinal direction) than the spacing between the blade fixing portions 104 formed on the fixing wall 103 of the casing 36. As shown in FIG. 9, the support member 53 has a circular round hole 105 bored in its right side end portion in bottom view in the width direction, and a slot 106 in generally slightly long ellipse in the width direction bored in its left side end portion in bottom view in the width direction.

(2-2) Leaf-spring Member

The leaf-spring member 54 is made of a metal thin plate. The leaf-spring member 54 is formed in generally the same width as the support member 53 in the width direction. A circular round hole 107 is bored in the proximal edge of the leaf-spring member 54 opposed to the support member 53 so as to be aligned with the round hole 105 in the support member 53, at its right side end portion in bottom view in the width direction, as shown in FIG. 8. In addition, a slot 108 in generally slightly long ellipse in the width direction is bored in the proximal edge thereof so as to be aligned with the slot 106 in the support member 53, at its left side end portion in bottom view in the width direction.

A notched portion 119 that is notched in a rectangular shape from a tip end edge (distal-end edge) of the leaf-spring member 54 toward the proximal-edge side thereof is formed in the vicinity of each end portion of the leaf-spring member 54 in the width direction.

(2-3) Pressure Contact Rubber

The pressure contact rubber 55 is provided at the tip end portion of the leaf-spring member 54 on the other side of the surface thereof opposed to the support member 53, and extends along the width direction. The pressure contact rubber 55 is made of elastic rubber such as insulating silicone rubber. The pressure contact rubber 55 is formed in a ridge having a generally elongated rectangular shape in bottom view protruding downward to approach the developing roller 39.

(2-4) Fixing of Support Member with Leaf-spring Member

As shown in FIG. 10, the support member 53 and the leaf-spring member 54 are adhesively fixed to each other with a double-sided tape 109. The double-sided tape 109 is a double-sided thermal adhesive tape which is coated with an adhesive on both sides, and in which an adhesive strength of the adhesive increases with heating. As such a double-sided thermal adhesive tape, for example, one having an adhesive strength of 0.6 kg or less before heating and an adhesive strength of 1.0 kg or more after heating is used.

These adhesive strengths before and after heating are obtained, for example, by bonding a 1.6±0.12 mm-thick sheet metal made of SECC and a 0.1±0.015 mm-thick sheet metal made of SUS301CSP-3/4H with a 6.5×100 mm-sized double-sided thermal adhesive tape, and then measuring a force required to remove those sheet metals in a direction orthogonal to the adhesive surfaces of the double-sided thermal adhesive tape on conditions of 130° C. and 0.35 MPa before and after heating and pressurizing for 10 seconds.

As shown in FIG. 9, the double-sided tape 109 is arranged along the front end edge (an end edge of the support member 53 on the side of the tip end portion of the leaf-spring member 54) of the support member 53, on the surface thereof facing the leaf-spring member 54 as shown in FIG. 9. The right side end portion of the double-sided tape 109 in bottom view reaches the vicinity of the round hole 105 in the support member 53, and the left side end portion on the other side in bottom view reaches a position in contact with the slot 106 in the support member 53.

As shown in FIG. 10, the double-sided tape 109 is attached to a position spaced at a given width from the proximal end edge of the leaf-spring member 54 to the tip end portion side, on the surface thereof facing the support member 53. Thus, the portion of the given width from the proximal end edge of the leaf-spring member 54 is facing the support member 53 without the double-sided tape 109

(2-5) Fixing of Layer-thickness Regulating Blade

As shown in FIG. 3, the layer-thickness regulating blade 40 is fixed to both of the blade fixing portions 104 of the casing 36 using a fixing screw 110 which is a right-handed screw, and a fixing screw 111 which is a left-handed screw. The fixing screw 110 is inserted through the round hole 107 (see FIG. 8) in the leaf-spring member 54 and the round hole 105 (see FIG. 9) in the support member 53, with its tip end portion screwed into a screw hole (not shown) formed in one blade fixing portion 104. The fixing screw 111 is inserted through the slot 108 (see FIG. 8) in the leaf-spring member 54 and the slot 106 (see FIG. 9) in the support member 53, with its tip end portion screwed into a screw hole (not shown) formed in the other blade fixing portion 104.

The right side end portion of the double-sided tape 109 in bottom view reaches the vicinity of the round hole 105 in the support member 53. Therefore, the double-sided tape 109 and a screw head 110A of the fixing screw 110 are opposed to each other via the leaf-spring member 54 in the state where the fixing screw 110 is inserted through the round hole 107 in the leaf-spring member 54 and the round hole 105 in the support member 53. On the other hand, the left side end portion of the double-sided tape 109 in bottom view reaches a position in contact with the slot 106 in the support member 53. Therefore, the double-sided tape 109 and the screw head 111A of the fixing screw 111 are opposed to each other via the leaf-spring member 54 in the state where the fixing screw 111 is inserted through the slot 108 in the leaf-spring member 54 and the slot 106 in the support member 53.

Further, the support member 53 has a longer length in the width direction than the spacing between the blade fixing portions 104. For this reason, in the state where the developing roller 39 is not mounted in the casing 36, the support member 53, the leaf-spring member 54, and the pressure contact rubber 55 are bent downward in a slightly convex-curved shape, as shown in FIG. 7. This bending is corrected by mounting the developing roller 39 to the casing 36. That is, as shown in FIG. 6, when the developing roller 39 is held by the casing 36, the developing roller 39 abuts against the pressure contact rubber 55, so that the pressure contact rubber 55 is pressed upward by the developing roller 39, thereby correcting the bending of the support member 53, the leaf-spring member 54, and the pressure contact rubber 55. As a result, in the layer-thickness regulating blade 40, the pressure contact rubber 55 abuts against the developing roller 39 at a uniform pressure in the axial direction (width direction) thereof from above by an elastic force of the leaf-spring member 54.

3. Operations and Effects

Thus, in the state where the developing roller 39 is not held by the casing 36, the support member 53 of the layer-thickness regulating blade 40 is fixed to both of the blade fixing portions 104 formed on the fixing wall 103 of the casing 36 so as to be bent toward the disposed position of the developing roller 39 (downward). When the developing roller 39 is held by the casing 36, the pressure contact rubber 55 is pressed by the developing roller 39, so that the bending of the support member 53 is corrected, and the pressure contact rubber 55 abuts against the developing roller 39 at a uniform pressure in the axial direction thereof. This can regulate the layer thickness of the toner carried on the surface of the developing roller 39 to be uniform. As a result, good supply of the toner from the developing roller 39 to the photosensitive drum 29 can be achieved, which in turn can lead to a good image formation.

In this embodiment, the blade fixing portions 104 to which the longitudinal end portions of the support member 53 are respectively fixed are provided on the fixing wall 103 of the casing 36, and the support member 53 has the longer length in the longitudinal direction than the spacing between those blade fixing portions 104. Therefore, the support member 53 can be surely bent toward the disposed position of the developing roller 39 by fixing each of the both longitudinal end portions of the support member 53 to the corresponding blade fixing portion 104.

The support member 53 and the leaf-spring member 54 are fixed to each other by adhesion via an adhesive layer made of the double-sided tape 109. Therefore, there is no deformation (wave deformation produced when the support member 53 and the leaf-spring member 54 are fixed to each other with a screw) in the leaf-spring member 54, thereby allowing the pressure contact rubber 55 to abut against the developing roller 39 at a more uniform pressure in the axial direction thereof. This can regulate the layer thickness of the toner carried on the surface of the developing roller 39 to be more uniform.

The portion of the given width from the proximal end edge of the leaf-spring member 54 faces the support member 53 without the double-sided tape 109. That is, there is no double-sided tape 109 interposed between the portion of the given width from the proximal end edge of the leaf-spring member 54 and the support member 53, so that the double-sided tape 109 is not extended out between the proximal end edge of the leaf-spring member 54 and the support member 53. Therefore, the double-sided tape 109 is less susceptible to adhesion of dust or the like. Even if dust or the like adheres thereto, it is possible to prevent the dust from being positioned on an optical path of the laser beams irradiated onto the photosensitive drum 29. Therefore, good exposure of the photosensitive drum 29 can be secured. As a result, a good image can be formed.

Besides, since the double-sided tape 109 serves as the adhesive layer, the adhesive layer can be surely placed in a position spaced at the given width from the proximal end edge of the leaf-spring member 54 by a simple operation that one surface of the double-sided tape 109 is attached to one of the support member 53 and the leaf-spring member 54, and the other surface of the double-sided tape 109 is attached to the other of them.

Further, the double-sided thermal adhesive tape adopted as the double-sided tape 109 has an adhesive strength of 0.6 kg or less before heating. Therefore, even if the tape is once attached to the support member 53 and/or the leaf-spring member 54, it can be removed easily, and again attached to the support member 53 and/or the leaf-spring member 54 as long as before heating. Thus, the use of the double-sided thermal adhesive tape enables the adhesive layer to be more surely placed in the position spaced at a given width from the proximal end edge of the leaf-spring member 54. After heating, the adhesive strength of the double-sided tape 109 increases to 1.0 kg or more. Therefore, it is possible to prevent the double-sided tape 109 from peeling off from the support member 53 and the leaf-spring member 54.

The support member 53 is fixed to the casing 36 with the fixing screws 110, 111 that penetrate the both longitudinal end portions of the support member 53. The double-sided tape 109 is arranged at a position where its right side end portion in bottom view is opposed to the screw head 110A of the fixing screw 110 via the leaf-spring member 54 and its left side end portion in bottom view is opposed to the screw head 111A of the fixing screw 111 via the leaf-spring member 54. Therefore, when the support member 53 is fixed to the casing 36, the both ends of the double-sided tape 109 are pressed by the screw heads 110A, 111A via the leaf-spring member 54. As a result, it is possible to prevent the double-sided tape 109 from peeling off and being lifted from the support member 53 or the leaf-spring member 54.

Furthermore, the fixing screws 110, 111 that penetrate the both longitudinal ends of the support member 53 are screwed into the casing 36 by mutually reverse rotation. Therefore, when both of the fixing screws 110, 111 penetrate the support member 53 and the leaf-spring member 54 to be screwed into the casing 36, tensile forces outward in the longitudinal direction can be respectively acted on the both longitudinal end portions of the support member 53 and of the leaf-spring member 54. As a result, it is possible to more effectively prevent the double-sided tape 109 from coming off and being lifted from the support member 53 or the leaf-spring member 54.

As shown in FIG. 3, in the state where the developing roller 39 is held by the casing 36, the pressure contact rubber 55 that is in abutment against the developing roller 39 is visible from outside the casing 36. Therefore, the existence/nonexistence of toner leakage from near the both longitudinal ends of the pressure contact rubber 55 can be readily confirmed.

In recent years, recycling has been emphasized in every field. In the field of an image forming apparatus also, recycling of a developing device and the like has been improved. Recycle of the developer cartridge 27 is also preferable, and in such a case, manufacturers such as printer manufacturers collect the used developer cartridges 27, re-fill the toner accommodation chamber 43 (see FIG. 2) with toners, and then re-supply it as a recycled product on the market. However, some of the developer cartridges 27 causing problems including toner leakage are not suitable for recycling. Therefore, manufacturers such as printer manufacturers need to check whether the collected developer cartridges 27 have any problems such as toner leakage or not. In the developer cartridge 27, the pressure contact rubber 55 that is in abutment against the developing roller 39 is visible from outside the casing 36, so that the existence/nonexistence of toner leakage from near the both longitudinal ends of the pressure contact rubber 55 can be readily confirmed, which is suitable for recycling.

Second Embodiment

Figure 11:
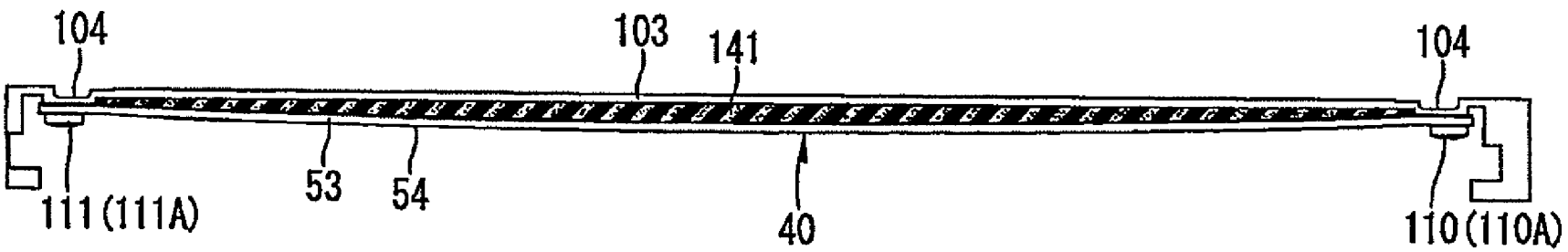
FIG. 11 is a bottom view of the major portion of a developer cartridge having a blade seal.

FIG. 11 is a bottom view of the major portion of the developer cartridge 27 according to a first variation. In this figure, the same reference numerals are used for portions equivalent to those respective portions described above. In the following, the detailed descriptions about the portions using the same reference numerals are omitted.

In the developer cartridge 27, a blade seal 141 that is an elastic member for preventing toner leakage from between the layer-thickness regulating blade 40 and the fixing wall 103 is arranged between the blade fixing portions 104. The blade seal 141 is made of, for example, a sponge material, and is protruding to the developing roller 39—disposed position side (downward) from the surface of the blade fixing portion 104 facing the support member 53, in the state where the developing roller 39 is not held by the casing 36.

This allows the support member 53 to be surely bent toward the disposed position of the developing roller 39 in the state where the developing roller 39 is not held by the casing 36. Then, when the developing roller 39 is held by the casing 36, the pressure contact rubber 55 (see FIG. 3) is pressed by the developing roller 39, and the pressure then causes elastic deformation of the blade seal 141. Therefore, the bending of the support member 53 is corrected, so that the pressure contact rubber 55 abuts against the developing roller 39 at a uniform pressure in the axial direction thereof. This can regulate the layer thickness of the toner carried on the surface of the developing roller 39 to be uniform.

Further, since the elastic member is of the blade seal 141, the support member 53 can be surely bent toward the disposed position of the developing roller 39, and also, toner leakage from between the support member 53 and the fixing walls 103 of the casing 36 can be prevented.

Third Embodiment

Figure 12:
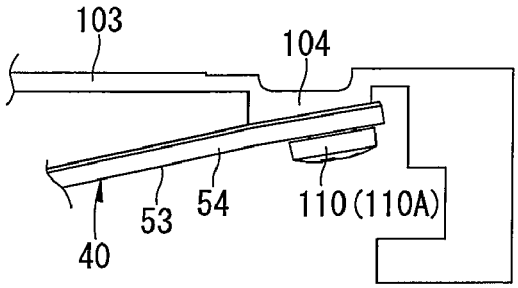
FIG. 12 is a view for explaining a variation of a blade fixing portion.

FIG. 12 is a view for explaining a variation of the blade fixing portion 104 (bottom view of the right side of the blade fixing portion 104 as viewed from below). In this figure, the same reference numerals are used for portions equivalent to those respective portions described above. In the following, except for the blade fixing portion 104, the detailed descriptions about the portions using the same reference numerals are omitted.

The blade fixing portion 104 shown in FIG. 12 has a larger amount of protrusion downward (direction opposed to the support member 53) toward the width direction inner side, and the contact surface thereof with the support member 53 is inclined. Therefore, the support member 53 can be surely bent toward the disposed position of the developing roller 39 by fixing each longitudinal end portion of the support member 53 to each blade fixing portion 104.

Fourth Embodiment

According to the above embodiment, the double-sided tape 109 is arranged at a position where the both longitudinal end portions (the right side end portion in bottom view and the left side end portion in bottom view) thereof are opposed to the screw heads 110A, 111A of the fixing screws 110, 111 via the leaf-spring member 54. However, the position of the double-sided tape 109 is not limited thereto, and, for example, when a washer 121 (indicated by a phantom line in FIG. 9) as an example of an interposing member is interposed between each of the screw heads 110A, 111A of the fixing screws 110, 111 and the leaf-spring member 54, the double-sided tape 109 may be arranged at a position where the both longitudinal end portions thereof are respectively opposed to the both washers 121 via the leaf-spring member 54.

With this arrangement, when the support member 53 is fixed to the casing 36, both ends of the double-sided tape 109 are pressed by the screw heads 110A, 111A of the fixing screws 110, 111 via the washers 121 and the leaf-spring member 54. As a result, it is possible to prevent the double-sided tape 109 from peeling off and being be lifted from the support member 53 or the leaf-spring member 54.

Fifth Embodiment

Figure 13:
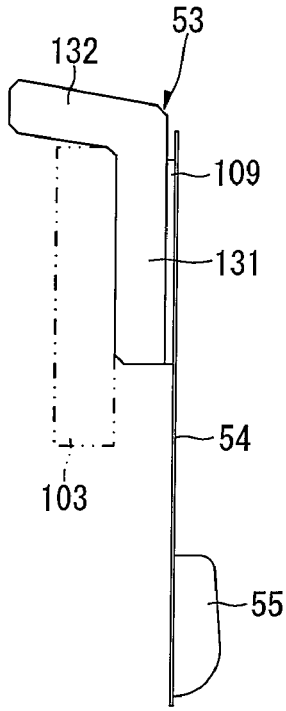
FIG. 13 is a view for explaining a variation of a shape of a support member.

FIG. 13 is a view for explaining a variation of a shape of the support member 53. In this figure, the same reference numerals are used for portions equivalent to those respective portions described above. In the following, except for the support member 53, the detailed descriptions about the portions using the same reference numerals are omitted.

The support member 53 shown in FIG. 13 has a opposed portion 131 that faces the leaf-spring member 54, and a non-opposed portion 132 that extends from the opposed portion 131 to the opposite side of the leaf-spring member 54, i.e., to the fixing wall 103 side of the casing 36.

When the support member 53 shown in FIG. 13 is adopted, it is no longer necessary to bend the support member 53 during attaching to the casing 36 because of a large strength of the support member 53. Even when the support member 53 is attached to the casing 36 with the opposing portion 131 extending in a planar shape, the pressure contact rubber 55 of the layer-thickness regulating blade 40 can be uniformly abutted against the developing roller 39 over the axial direction. This can regulate the layer thickness of the toner carried on the surface of the developing roller 39 to be uniform.

Sixth Embodiment

The adhesive layer is not limited to the double-sided tape 109, and may be formed by coating the support member 53 and/or the leaf-spring member 54 with an adhesive.

Seventh Embodiment

The color laser printer of a tandem type was illustrated as an image forming apparatus. However, the image forming apparatus is not limited thereto, and may be, for example, a color laser printer of an intermediate transfer type in which developing agent images for respective colors are once transferred from respective image carriers to an intermediate transfer body, and thereafter, transferred onto a recording medium by one operation. Further, the image forming apparatus is not limited to a color laser printer, and may be a monochrome laser printer.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A developing device comprising:

a casing;

a developing roller held by the casing and carrying a developing agent; and a layer-thickness regulating blade for regulating a layer thickness of the developing agent carried on the developing roller, wherein the layer-thickness regulating blade includes:

a support member that is formed in a rectangular shape extending in an axial direction of the developing roller, and is attached to the casing;

a leaf-spring member that is supported by the support member and extends toward the developing roller from the support member; and an abutment portion provided at a tip end portion of the leaf-spring member and abutting against the developing roller, wherein the developing device includes:

a blade fixing portion that is provided in the casing, is opposed to each longitudinal end portion of the support member, and fixes the corresponding longitudinal end portion of the support member thus opposed; and an elastic member arranged between the blade fixing portions, interposed between the casing and the support member, and protruding to a side of the disposed position of the developing roller from an opposed surface of the blade fixing portion to the support member in the state where the developing roller is not held by the casing;

wherein in a state where the developing roller is held by the casing, the abutment portion abuts against the developing roller at a uniform pressure in the axial direction of the developing roller, and in the state where the developing roller is not held by the casing, the support member is attached in the casing so that the layer-thickness regulating blade is bent toward a disposed position of the developing roller.

2. The developing device according to claim 1, wherein the elastic member is a blade seal that seals between the casing and the support member.

3. The developing device according to claim 1, wherein the support member is formed longer in a longitudinal direction thereof than a spacing between the blade fixing portions.

4. The developing device according to claim 1, further comprising an adhesive layer interposed between the support member and the leaf-spring member, for fixing the support member and the leaf-spring member by adhesion.

5. The developing device according to claim 4, wherein the adhesive layer is a double-sided tape coated with an adhesive on both sides thereof.

6. The developing device according to claim 4, wherein the abutment portion is visible from outside the casing in the state where the developing roller is held by the casing.

7. An image forming apparatus, comprising:

a casing;

a developing roller held by the casing and carrying a developing agent;

a layer-thickness regulating blade for regulating a layer thickness of the developing agent carried on the developing roller;

an image carrier supplied with the developing agent from the developing roller, wherein the layer-thickness regulating blade includes:

a support member formed in a rectangular shape extending in an axial direction of the developing roller, and attached to the casing;

a leaf-spring member that is supported by the support member and extends toward the developing roller from the support member;

an abutment portion provided at a tip end portion of the leaf-spring member and abutting against the developing roller; and an adhesive layer arranged between the support member and the leaf-spring member so as to be spaced at a given width from a proximal end edge of the leaf-spring member on the other side of the tip end portion thereof to a tip end portion side, for fixing the support member and the leaf-spring member by adhesion, wherein a portion of the given width from the proximal end edge of the leaf-spring member is opposed to the support member without the adhesive layer interposed therebetween; and wherein in a state where the developing roller is held by the casing, the abutment portion abuts against the developing roller at a uniform pressure in the axial direction of the developing roller, and in a state where the developing roller is not held by the casing, the support member is attached in the casing so that the layer-thickness regulating blade is bent toward a disposed position of the developing roller.

8. A developing device for developing with a developing agent an electrostatic latent image formed by irradiating with light a surface of an image carrier provided in an image forming apparatus, comprising:

a casing;

a developing roller held by the casing and carrying a developing agent to be supplied onto the surface of the image carrier; and a layer-thickness regulating blade for regulating a layer thickness of the developing agent carried on the developing roller, wherein the layer-thickness regulating blade includes:

a support member attached in the casing, and arranged in a position closer to an optical path of the light irradiated onto the image carrier than the developing roller;

a leaf-spring member that is supported by the support member and extends toward the developing roller from the support member;

an abutment portion provided at a tip end portion of the leaf-spring member and abutting against the developing roller; and an adhesive layer arranged between the support member and the leaf-spring member so as to be spaced at a given width from a proximal end edge of the leaf-spring member on the other side of the tip end portion thereof to a tip end portion side, for fixing the support member and the leaf-spring member by adhesion, wherein a portion of the given width from the proximal end edge of the leaf-spring member is opposed to the support member without the adhesive layer interposed therebetween.

9. The developing device according to claim 8, wherein the adhesive layer is a double-sided tape coated with an adhesive on both sides thereof.

10. The developing device according to claim 9, wherein the double-sided tape is a double-sided thermal adhesive tape having an adhesive strength of 0.6 kg or less before heating and an adhesive strength of 1.0 kg or more after heating.

11. The developing device according to claim 8, wherein the support member is formed in a rectangular shape extending in an axial direction of the developing roller, the developing device includes a screw that penetrates each longitudinal end portion of the leaf-spring member and that of the support member from the leaf-spring member side, for fixing the support member to the casing, wherein the adhesive layer extends in a longitudinal direction of the support member and is arranged at a position where each end portion of the adhesive layer in the longitudinal direction is opposed to a screw head of the corresponding screw.

12. The developing device according to claim 11, wherein each of the screws is screwed into the casing by mutually reverse rotation.

13. The developing device according to claim 8, wherein the support member is formed in a rectangular shape extending in an axial direction of the developing roller, and the developing device includes:

a screw that penetrates each longitudinal end portion of the leaf-spring member and that of the support member from the leaf-spring member side, for fixing the support member to the casing; and an interposing member that interposes between the screw head of the screw and the leaf-spring member, wherein the adhesive layer extends in a longitudinal direction of the support member and is arranged at a position where each end portion of the support member in the longitudinal direction is opposed to the interposing member.

14. The developing device according to claim 13, wherein each of the screws is screwed into the casing by mutually reverse rotation.

15. The developing device according to claim 8, wherein the support member is bent so as to have an opposed portion opposed to the leaf-spring member, and a non-opposed portion extended from the opposed portion to the opposite side of a leaf-spring member side.

16. An image forming apparatus comprising:

an image carrier;

an exposure device for forming an electrostatic latent image by irradiating a surface of the image carrier with light; and a developing device for developing the electrostatic latent image with a developing agent, wherein the developing device includes:

a casing;

a developing roller held by the casing and carrying the developing agent to be supplied onto the surface of the image carrier; and a layer-thickness regulating blade for regulating a layer thickness of the developing agent carried on the developing roller, wherein the layer-thickness regulating blade includes:

a support member attached in the casing, and arranged in a position closer to an optical path of the light irradiated onto the image carrier than the developing roller;

a leaf-spring member that is supported by the support member and extends toward the developing roller from the support member;

an abutment portion provided at a tip end portion of the leaf-spring member and abutting against the developing roller; and an adhesive layer that is arranged between the support member and the leaf-spring member so as to be spaced at a given width from a proximal end edge of the leaf-spring member on the other side of the tip end portion thereof to a tip end portion side, for fixing the support member and the leaf-spring member by adhesion, wherein a portion of the given width from the proximal end edge of the leaf-spring member is opposed to the support member without the adhesive layer interposed therebetween.

17. A developing device comprising:

a casing;

a developing roller held by the casing and carrying a developing agent; and a layer-thickness regulating blade for regulating a layer thickness of the developing agent carried on the developing roller, wherein the layer-thickness regulating blade includes:

a support member that is formed in a rectangular shape extending in an axial direction of the developing roller, and is attached to the casing;

a leaf-spring member that is supported by the support member and extends toward the developing roller from the support member; and an abutment portion provided at a tip end portion of the leaf-spring member and abutting against the developing roller; and a blade fixing portion that is provided in the casing, is opposed to each longitudinal end portion of the support member, has a larger amount of protrusion in an opposed direction to the support member toward a longitudinal inner side, and fixes the corresponding longitudinal end portion of the support member thus opposed;

wherein in a state where the developing roller is held by the casing, the abutment portion abuts against the developing roller at a uniform pressure in the axial direction of the developing roller, and in a state where the developing roller is not held by the casing, the support member is attached in the casing so that the layer-thickness regulating blade is bent toward a disposed position of the developing roller.

18. A developing device comprising:

a casing;

a developing roller held by the casing and carrying a developing agent; and a layer-thickness regulating blade for regulating a layer thickness of the developing agent carried on the developing roller, wherein the layer-thickness regulating blade includes:

a support member that is formed in a rectangular shape extending in an axial direction of the developing roller, and is attached to the casing;

a leaf-spring member that is supported by the support member and extends toward the developing roller from the support member;

an adhesive layer interposed between the support member and the leaf-spring member so as to be spaced at a given width from a proximal end edge of the leaf-spring member on the other side of the tip end portion thereof to a tip end portion side for fixing the support member and the leaf-spring member by adhesion, wherein a portion of the given width from the proximal end edge of the leaf-spring member is opposed to the support member without the adhesive layer interposed therebetween; and an abutment portion provided at a tip end portion of the leaf-spring member and abutting against the developing roller, wherein in a state where the developing roller is held by the casing, the abutment portion abuts against the developing roller at a uniform pressure in the axial direction of the developing roller, and in a state where the developing roller is not held by the casing, the support member is attached in the casing so that the layer-thickness regulating blade is bent toward a disposed position of the developing roller.

* * * * *